US012600560B2

(12) United States Patent
Kohen

(10) Patent No.: US 12,600,560 B2
(45) Date of Patent: Apr. 14, 2026

(54) HEATING UNIT

(71) Applicant: LIKUA ENDUSTRIYEL AMBALAJ MALZM. SAN. VE TIC. LTD. STI., Istanbul (TR)

(72) Inventor: Yusuf Kohen, Istanbul (TR)

(73) Assignee: LIKUA ENDUSTRIYEL AMBALAJ MALZM. SAN. VE TIC. LTD. STI., Istanbul (TR)

( * ) Notice: Subject to any disclaimer, the term of this patent is extended or adjusted under 35 U.S.C. 154(b) by 222 days.

(21) Appl. No.: 18/010,209

(22) PCT Filed: May 6, 2021

(86) PCT No.: PCT/TR2021/050435

§ 371 (c)(1),
(2) Date: Dec. 14, 2022

(87) PCT Pub. No.: WO2022/060321

PCT Pub. Date: Mar. 24, 2022

(65) Prior Publication Data

US 2023/0312231 A1 Oct. 5, 2023

(30) Foreign Application Priority Data

Sep. 15, 2020 (TR) ..... 2020/14636

(51) Int. Cl.
*B65D 88/74* (2006.01)

(52) U.S. Cl.
CPC ..... *B65D 88/74* (2013.01)

(58) Field of Classification Search
CPC ..... B65D 88/74; B65D 88/744
USPC ..... 220/592.28
See application file for complete search history.

(56) References Cited

U.S. PATENT DOCUMENTS 2,014,264 A * 9/1935 Patrick ..... B65D 88/48 100/211
3,233,662 A * 2/1966 Chuen ..... A47C 21/048 607/104
3,346,101 A * 10/1967 Pestka ..... B65D 81/052 217/53
4,211,208 A * 7/1980 Lindner ..... F28D 20/02 126/400
5,205,348 A * 4/1993 Tousignant ..... F28F 3/12 257/E23.098
7,096,926 B2 * 8/2006 Belady ..... F28F 23/00 257/E23.09

(Continued)

FOREIGN PATENT DOCUMENTS

CN 207698470 U 8/2018
WO 9900322 A1 1/1999
WO 2009074841 A1 6/2009

*Primary Examiner* — Rafael A Ortiz
*Assistant Examiner* — Niki M Eloshway
(74) *Attorney, Agent, or Firm* — Bayramoglu Law Offices LLC

(57) ABSTRACT

A heating unit for heating carrying chambers is provided. In the heating unit, fluid can be stored. The heating unit can carry fluid from one location to another location by means of a vehicle. The improvement is that the heating unit includes at least one flexible body wherein hot vapor can be filled and at least one support element positioned in the at least one flexible body in order to be positioned between the carrying chamber and the inner wall of the container.

5 Claims, 4 Drawing Sheets

(56) References Cited

U.S. PATENT DOCUMENTS

| | | | | |
|---|---|---|---|---|
| 10,806,054 | B1 * | 10/2020 | Mahalingam | H05K 7/2049 |
| 2012/0247067 | A1 | 10/2012 | Podd et al. | |

* cited by examiner

HEATING UNIT

CROSS REFERENCE TO THE RELATED APPLICATIONS

This application is the national phase entry of International Application No. PCT/TR2021/050435 filed on May 6, 2021, which is based upon and claims priority to Turkish Patent Application No. 2020/14636 filed on Sep. 15, 2020, the entire contents of which are incorporated herein by reference.

TECHNICAL FIELD

The present invention relates to a heating unit for heating carrying chambers in which a fluid can be stored and which the fluid can be carried from one location to another location by means of a vehicle.

BACKGROUND

Solutions provided by flexible big bags have been applied for long years in transportation of particularly granule type non-fluid materials. As for granule type materials, the usage of flexible big bags or flexible carriers in transportation of liquids/liquid-based materials can present useful solutions. Besides the technical conditions like liquid transportation, sealing, filling and discharging of the liquid to/from the carrying medium and preserving the hygiene characteristic of this medium, the reduction of the costs related to transportation are also among the primary issues which must be taken into attention. In order to meet said requirements, flexible tanks which can be carried in containers can be used.

Even if some types of goods like palm oil, sugar syrup carried in flexible tanks are in liquid form during filling, they get frozen depending on the weather conditions in the countries they arrive at, and the products cannot be discharged from the packages thereof. In other words, when the temperature of the liquid placed into the flexible tank decreases under a specific temperature or changes in phase or when there is the risk of losing various characteristics like the chemical structure thereof, the flexible tank has to be heated during discharge. In order to provide this, serpentine pipes, wherein hot water is circulated, are placed to the container base. In order for the serpentine pipes, used in said method, to carry the load thereon, the serpentine pipes must be selected from a thick material. However, in this case, the heat transmission of the pipes is very weak and the flexible tank is heated only regionally. Moreover, water cannot be circulated in the desired manner through the pipes crushed due to the weight of the flexible tank.

In the cargo transportation system disclosed in the application with reference US2012247067, a transportation container, a load carrier and a vapor distribution system are disclosed. The vapor distribution system comprises a vapor diffuser for heating the whole surface of the cargo carrier.

As a result, because of the abovementioned problems, an improvement is required in the related technical field.

SUMMARY

The present invention relates to a heating unit, for eliminating the abovementioned disadvantages and for bringing new advantages to the related technical field.

An object of the present invention is to provide a heating unit with reduced cost and with facilitated usage for heating of the carrying chambers used in transportation of fluid materials.

In order to realize the abovementioned objects and the objects which are to be deducted from the detailed description below, the present invention is a heating unit for heating carrying chambers wherein fluid can be stored and which can carry fluid from one location to another location by means of a vehicle. Accordingly, the subject matter heating unit comprises at least one flexible body wherein hot vapor can be filled, and at least one support element positioned in said flexible body; in order to be positioned between the carrying chamber and the inner wall of the container. Thus, hot vapor is easily filled into the heating chamber provided in the vicinity of the carrying chamber wherein the materials to be carried are placed, and the carrying chamber is easily heated.

In a possible embodiment of the present invention, pluralities of support elements are provided in a manner allowing hot vapor circulation in between. Thus, the carrying chamber is prevented from compressing the flexible body, and circulation of the hot vapor in the flexible body is provided.

In a possible embodiment of the present invention, in order to delimit movement of the support element inside the flexible body, at least one joining part, which connects an upper wall and a lower wall of the flexible body, is provided between the support elements.

In a possible embodiment of the present invention, at least one passage port is provided which is configured to allow passage of hot vapor between said joining parts.

In a possible embodiment of the present invention, at least one discharge opening is provided on the flexible body in order to prevent further increase of the inner pressure when the inner pressure of the flexible body is over a predetermined value.

REFERENCE NUMERALS

10: container; 11: base; 12: side wall; 13: door; 20: carrying chamber; 30: heating unit; 31: flexible body; 311: upper wall; 312: lower wall; 32: filling inlet; 33: discharge opening; 34: joining part; 35: passage port; 36: discharge inlet; and 37: support element.

DETAILED DESCRIPTION OF THE EMBODIMENTS

In this detailed description, the subject matter heating unit (30) is explained with references to examples without forming any restrictive effect only in order to make the subject more understandable.

Figure 1:
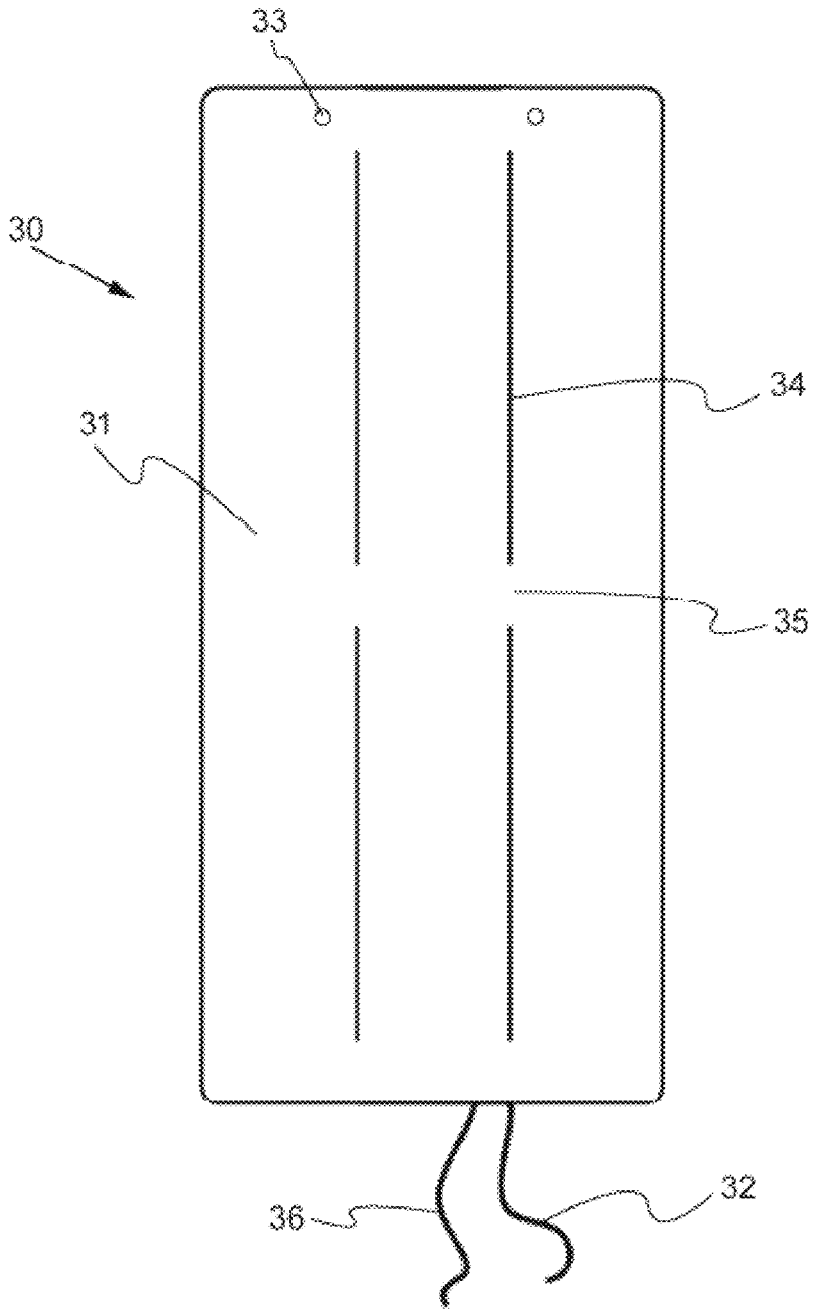
In FIG. 1, a representative top view of the subject matter heating unit is given.

With reference to FIG. 1, the heating unit (30) has a flexible body (31) wherein hot vapor can be positioned. Said flexible body (31) is made of a flexible, fabric-like material. An upper wall (311) and a lower wall (312) of the flexible body (31) are connected to each other through predetermined regions, and thereby, the flexible body (31) is separated into compartments. The parts which connect the upper wall (311) and the lower wall (312) are defined as a joining part (34). Said joining parts (34) can be formed by means of adhering or seaming the lower wall (312) and the upper wall (311) to each other. Said joining parts (34) can extend in the direction of the width or length of the flexible body (31). In the same direction, there can be pluralities of joining parts (34) in a manner defining a passage port (35) in between.

Figure 2:
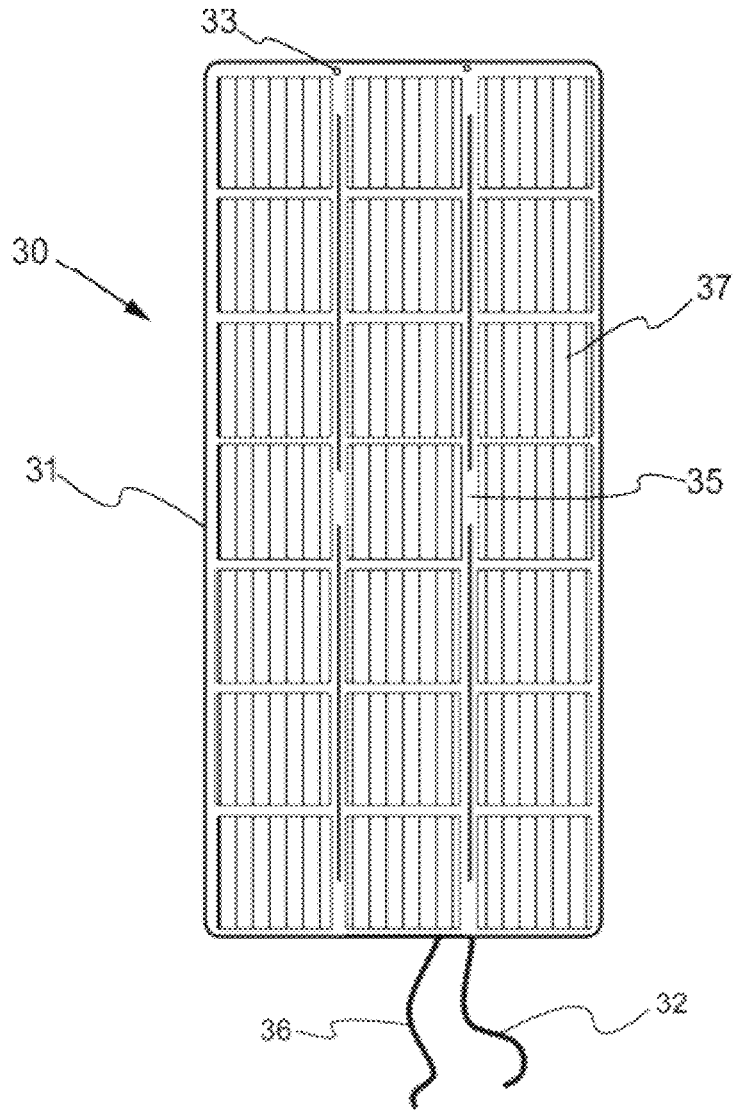
In FIG. 2, a representative top cross-sectional view of the subject matter heating unit is given.
Figure 3:
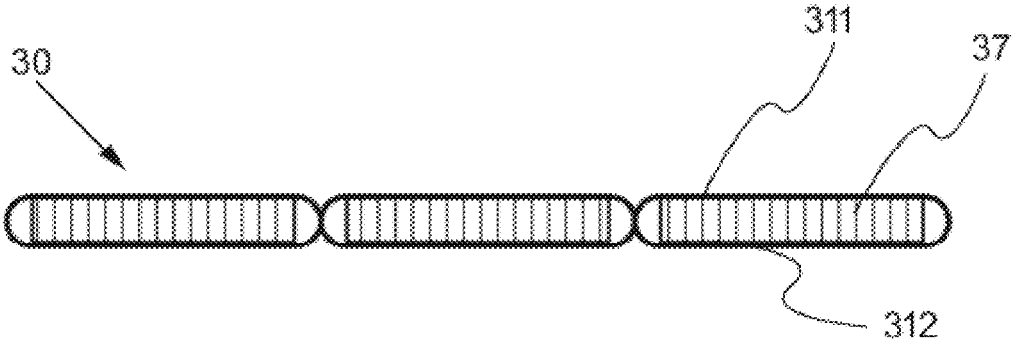
In FIG. 3, a representative frontal cross-sectional view of the subject matter heating unit is given.

With reference to FIGS. 2 and 3, there is at least one support element (37) positioned in the flexible body (31). Said support element (37) is made of a material having hardness such that said support element (37) can at least partially protect its form when load is applied thereon. In other words, when load is applied on the support element (37), the minimum possible shape change occurs, and the upper wall (311) and the lower wall (312) of the flexible body (31) are prevented from approaching each other. The support element (37) is configured to allow movement of the hot vapor which is to be filled into the flexible body (31). In a possible embodiment of the present invention, the support element (37) is provided in grid form. In said embodiment, the support elements (37) are positioned between the joining parts (34) and the movements of the support elements (37) are limited thanks to the joining parts (34).

Figure 4:
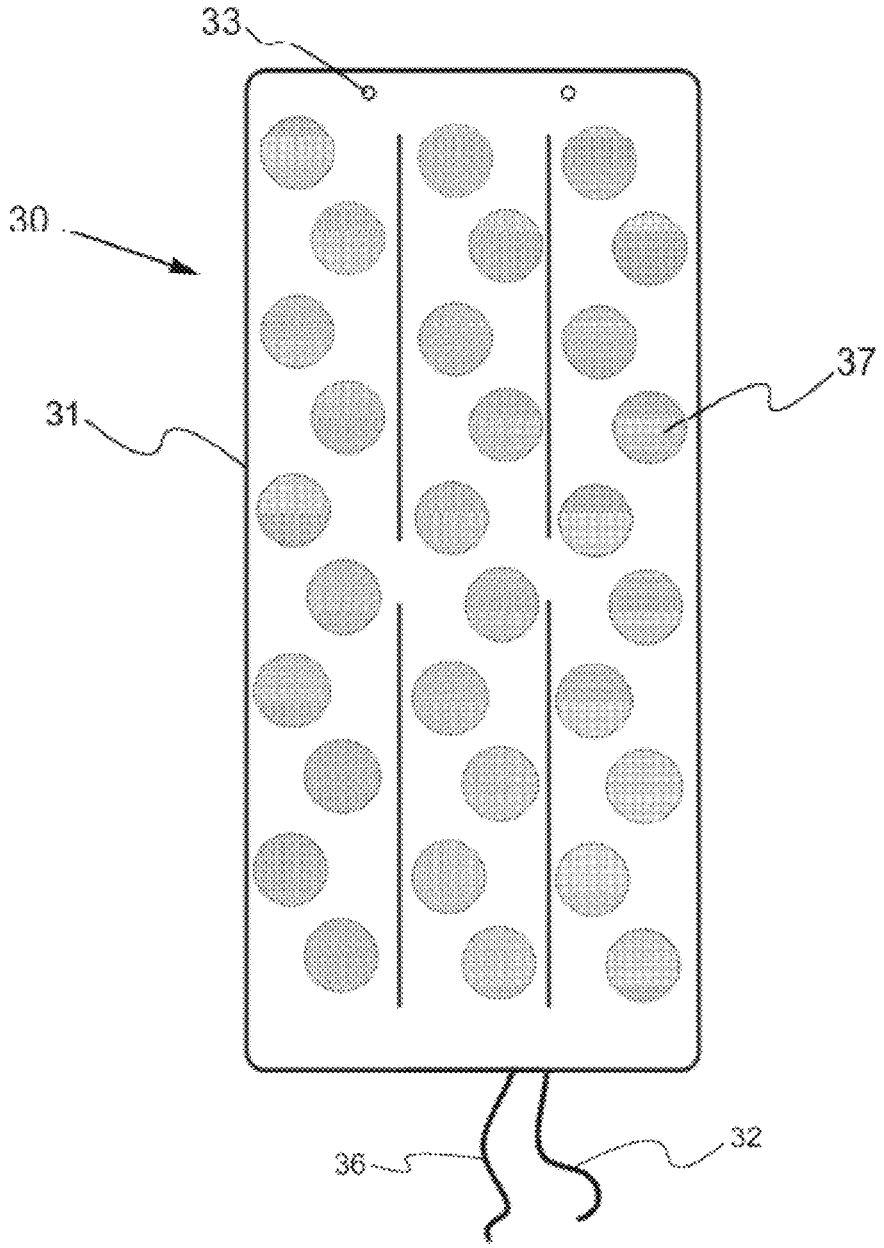
In FIG. 4, a representative top cross-sectional view of another possible embodiment of the subject matter heating unit is given.

With reference to FIG. 4, in another possible embodiment of the present invention, the support element (37) is provided in a sphere-like form. In said embodiment, while the support elements (37) support carrying of the load applied thereon, circulation of the hot vapor through the parts which remain between the sphere forms is provided.

In another possible embodiment of the present invention, chambers are formed between the joining parts (34), and materials, having particle structure, can be filled into these chambers. Said material having particle structure can be sand or a similar material.

With reference to FIGS. 2 and 4, there is at least filling inlet (32) which is provided on the flexible body (31) in the subject matter heating unit (30). Said filling inlet (32) is used for filling hot vapor into the flexible body (31). In a similar manner, at least one discharge inlet (36), provided on the flexible body (31), is used for discharging the hot vapor.

With reference to FIGS. 2 and 4, in a possible embodiment of the present invention, there is a discharge opening (33) provided on the flexible body (31). When load is applied onto the flexible body (31) and when the inner pressure exceeds a predetermined value, hot vapor is discharged through said discharge opening (33). In a possible embodiment of the present invention, a valve is positioned at the discharge opening (33). Thus, when the inner pressure increases as a result of the load applied to the heating unit (30), the flexible body (31) is prevented from being torn or deformed.

Figure 5:
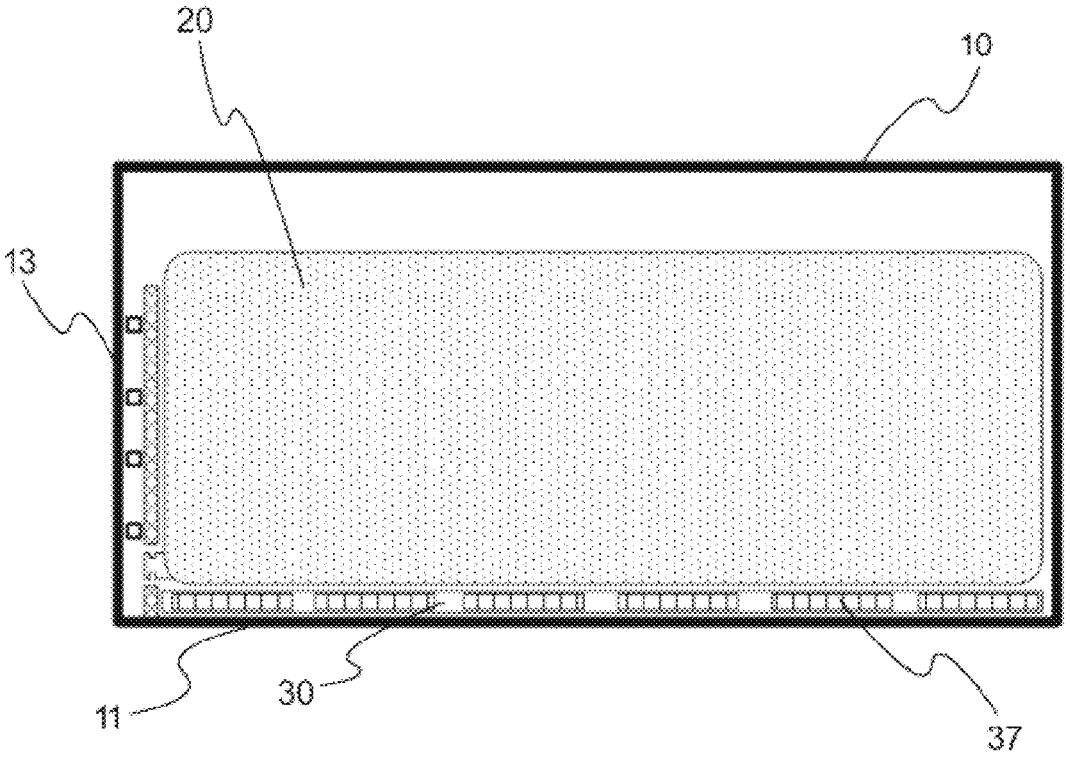
In FIG. 5, a representative lateral cross-sectional view where the subject matter heating unit is positioned in the container is given.
Figure 6:
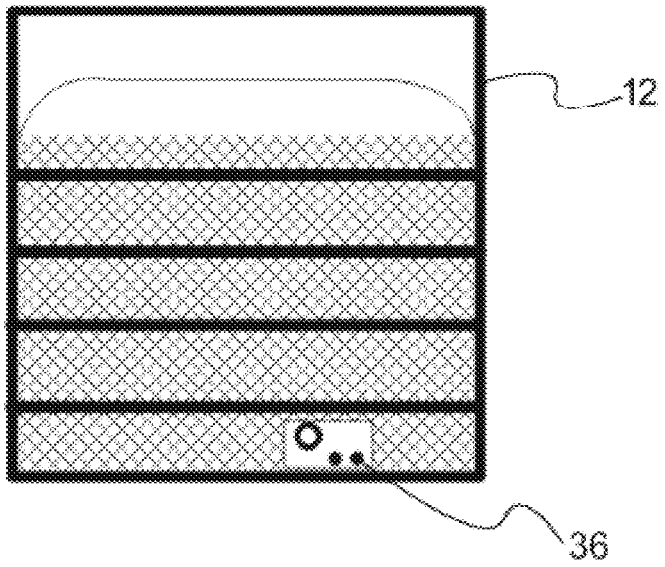
In FIG. 6, a representative frontal cross-sectional view where the subject matter heating unit is positioned in the container is given.

As can be seen in FIGS. 5 and 6, the subject matter heating unit (30) is provided so as to stay between the carrying chamber and the inner wall of the container (10).

The subject matter heating unit (30) can be positioned under the carrying chamber (20), or it can be positioned between the carrying chamber (20) and the side walls (12) of the container (10).

Thanks to said embodiments of the subject matter heating unit (30), the loads, which need heating, can be heated easily and with low costs.

In an exemplary application, the subject matter heating unit (30) is positioned to the base (11) of the container (10). Afterwards, the carrying chamber (20) is placed thereon and the carrying chamber (20) is filled. When the carrying chamber (20) is filled, the load is applied onto the support elements (37) provided in the flexible body (31). When the material inside the carrying chamber (20) is desired to be heated, hot vapor is sent into the flexible body (31) through the filling inlet (32). The heat of the hot vapor, which circulates between the support elements (37) and which fills in the flexible body (31), is transmitted to the material, which exists in the carrying chamber (20), through the surfaces of the heating unit (30) which contact the carrying chamber (20). Thus, the material provided inside the carrying chamber (20) can be heated.

The protection scope of the present invention is set forth in the annexed claims and cannot be restricted to the illustrative disclosures given above, under the detailed description. It is because a person skilled in the relevant art can obviously produce similar embodiments under the light of the foregoing disclosures, without departing from the main principles of the present invention.

What is claimed is:

1. A heating unit for heating carrying chambers in which a fluid is stored and carry the fluid from one location to another location by means of a vehicle, the heating unit comprising:

a flexible body made of a flexible, fabric-like material and comprising an upper wall and a lower wall, wherein the flexible body is configured to be filled with a hot vapor, and wherein the flexible body is positioned between carrying chambers and an inner wall of a container;

a plurality of support elements positioned in the flexible body, wherein the plurality of support elements are moveable inside the flexible body and the plurality of support elements are made of a material having a hardness such that, when load is applied to the heating unit, the upper wall and the lower wall are prevented from approaching each other;

at least one joining part separating the flexible body into compartments by connecting portions of the upper wall and portions of the lower wall together, wherein the at least one joining part is provided between the plurality of support elements in order to delimit a movement of the plurality of support elements inside the flexible body; and at least one passage port in between the compartments, wherein the at least one passage port is configured to allow a passage of the hot vapor between the compartments.

2. The heating unit according to claim 1, wherein the plurality of support elements is configured to allow the hot vapor to circulate in between the plurality of support elements.

3. The heating unit according to claim 1, wherein the at least one joining part is formed by adhering or seaming the upper wall and the lower wall to each other.

4. The heating unit according to claim 1, further comprising:

at least one filling inlet provided on the flexible body, wherein the at least one filling inlet is configured to fill hot vapor into the flexible body; and at least one discharge inlet provided on the flexible body, wherein the at least one discharge inlet is configured to discharge the hot vapor from the flexible body.

5. The heating unit according to claim 1, further comprising at least one discharge opening on the flexible body and a valve positioned at the discharge opening, wherein the valve is configured to discharge the hot vapor through the discharge opening when an inner pressure of the flexible body exceeds a predetermined value.

* * * * *